US005826648A

United States Patent [19]

Shimoya et al.

[11] Patent Number: 5,826,648

[45] Date of Patent: Oct. 27, 1998

[54] LAMINATED TYPE HEAT EXCHANGER

[75] Inventors: Masahiro Shimoya; Eiichi Torigoe, both of Kariya, Japan

[73] Assignee: Denso Corporation, Kariya, Japan

[21] Appl. No.: 766,172

[22] Filed: Dec. 12, 1996

[30] Foreign Application Priority Data

Dec. 19, 1995 [JP] Japan ..... 7-330701

[51] Int. Cl.[6] ..... F28D 1/03

[52] U.S. Cl. ..... 165/153; 165/70; 165/176; 165/178

[58] Field of Search ..... 165/70, 153, 176, 165/178; 62/515

[56] References Cited

U.S. PATENT DOCUMENTS

| | | | |
|---|---|---|---|
| 5,042,577 | 8/1991 | Suzumura | 165/153 |
| 5,178,207 | 1/1993 | Bergqvist et al. | 165/70 X |
| 5,417,280 | 5/1995 | Hayashi et al. | 165/153 |
| 5,511,611 | 4/1996 | Nishishita | 165/153 |
| 5,544,702 | 8/1996 | Nishishita | 165/153 |

FOREIGN PATENT DOCUMENTS

A-59-225702 12/1984 Japan .

*Primary Examiner*—Leonard R. Leo
*Attorney, Agent, or Firm*—Harness, Dickey & Pierce, PLC

[57] ABSTRACT

A laminated type heat exchanger according to the present invention includes a plurality of metal plates laminated with each other to form a fluid passage and an end plate disposed at an end of the laminated metal plates. The end plate has two protrusions for forming a fluid inlet passage and a fluid outlet passage for the fluid passage, respectively, and a joining portion formed between the two protrusions, for being brazed to the most-sided metal plate. A through hole is formed at the center of the joining portion. Even if there is a defective brazed portion in the joining portion, fluid which flows from the fluid inlet directly into the outlet passages through the defective brazed portion always leaks to the outside from the through hole. As a result, an internal leakage between the fluid inlet and outlet passages can be detected securely.

18 Claims, 5 Drawing Sheets

COMPARATIVE EXAMPLE

LAMINATED TYPE HEAT EXCHANGER

CROSS REFERENCE TO RELATED APPLICATION

This application is based upon and claims the benefit of priority of the prior Japanese Patent Application No. Hei. 7-330701 filed on Dec. 19, 1995, the content of which is incorporated herein by reference.

BACKGROUND OF THE INVENTION

1. Field of the Invention

The present invention relates to a laminated type heat exchanger in which fluid passages are formed by a laminated structure of thin metal plates, and is suitably applied to an evaporator for evaporating a refrigerant of a refrigerating cycle.

2. Description of Related Art

Conventionally, as this kind of the laminated type heat exchanger, in JP-A-59-225702, there has been proposed a laminated type heat exchanger in which fluid passages of a heat exchanging portion for exchanging heat between inside fluid (refrigerant) and outside fluid (air) are formed by a laminated structure of the thin metal plates. The heat exchanger has an end plate disposed at an end thereof in a laminating direction of the metal plate, and two protrusions are formed on the end plate. Spaces between the protrusions and the adjacent thin metal plate function as a fluid inlet passage and a fluid outlet passage. The fluid inlet passage communicates with inlet portions of the fluid passages and the fluid outlet passage communicates with outlet portions of the fluid passages. The thin metal plates of the heat exchanging portion as well as the end plate and the thin metal plate of the end portion of the heat exchanging portion are integrally joined (brazed) to each other.

In this heat exchanger, the fluid inlet passage and the fluid outlet passage are formed by the protrusions formed on the end plate itself integrally brazed to one of the thin metal plates, whereby the structure of the heat exchanger is simplified.

The inventors have experimented and studied the above mentioned heat exchanger and found a problem that, at manufacturing the heat exchanger, there causes a fluid (refrigerant) internal leakage, because the fluid inlet passage and the fluid outlet passage are formed on a single end plate. That is, since the fluid inlet passage and the fluid outlet passage are formed on a single end plate itself, if a defective connection is caused at the connecting portion for partitioning the fluid inlet passage and the fluid outlet passage, the fluid in the fluid inlet passage does not flow into the fluid passages, but may flow directly into the fluid outlet passage while bypassing the fluid inlet passage. This phenomena is the fluid (refrigerant) internal leakage. If such an internal leakage occurs, an amount of the fluid flowing in the fluid passages is greatly decreased, whereby a heat exchange efficiency is greatly lowered.

In addition, conventionally, it is difficult to confirm whether or not the internal leakage phenomena is generated in the leakage inspection after the heat exchanger has been manufactured, for the following reason.

That is, since the fluid inlet side and the fluid outlet side of the heat exchanger essentially communicate with each other through the fluid passages, it is difficult to distinguish the internal leakage state from the proper communicating state through the fluid passages. Therefore, it is difficult to confirm the internal leakage in the leakage inspection after the heat exchanger has been manufactured.

SUMMARY OF THE INVENTION

The present invention has been accomplished in view of the above mentioned problem and an object of the present invention is to securely detect the internal leakage in a laminated type heat exchanger in which a fluid inlet passage and a fluid outlet passage are formed on an end plate itself.

According to the present invention, a laminated type heat exchanger includes a heat exchanging portion formed by laminating a plurality of thin metal plates with other to form a fluid passage having an inlet portion and an outlet portion in which inside fluid flows, and an end plate connected to an end portion of said heat exchanging portion. The end plated includes two protrusions and a joining portion formed between the two protrusions such that a fluid inlet passage communicating with the inlet portion and a fluid outlet passage communicating with the outlet portion are independently formed. At least one of the joining portion and the thin metal plate forming the side surface to which the joining portion is joined includes a through hole having a width being substantially equal to a width of each of the two protrusions.

Preferably, one of the joining portion and the thin metal plate may include a contacting portion formed around an outer circumference of the through hole entirely with an uniform width, for contacting with the other one of the thin metal plate and the joining portion.

More preferably, there may be provided a joint member connected to the end plate and having an inlet pipe communicating with the fluid inlet passage and an outlet pipe communicating with the fluid outlet passage.

Accordingly, even if there are some defective brazed portions in the joining portion between the two protrusions, for forming the fluid inlet passage and the fluid outlet passage, the through hole is formed with the width being equal to the width of the two protrusions or more. Therefore, the inside fluid due to the internal leakage always leaks to the outside from the through hole, and the fluid internal leakage between the fluid inlet and outlet passages can be detected securely in the inspection.

Further, in the case that the contacting portion is formed around an outer circumference of the through hole so as to have a uniform width, the joining strength between the joining plate and the end plate can be increased.

Other objects and features of the present invention will become more readily apparent from a better understanding of the preferred embodiments described below with reference to the following figures.

DETAILED DESCRIPTION OF THE PREFERRED EMBODIMENTS

Embodiments according to the present invention will be described hereinafter with reference to the drawings.

In the embodiments illustrated in FIGS. 1–4, a heat exchanger of the present invention is adopted to a refrigerant evaporator 1 in a refrigerating cycle of an automotive air conditioning system. In the refrigerating cycle, refrigerant is decompressed and expanded into a gas-liquid two phase refrigerant having a low temperature and a low pressure by means of a thermal type expansion valve (not shown), and then flows into the evaporator 1.

Figure 1:
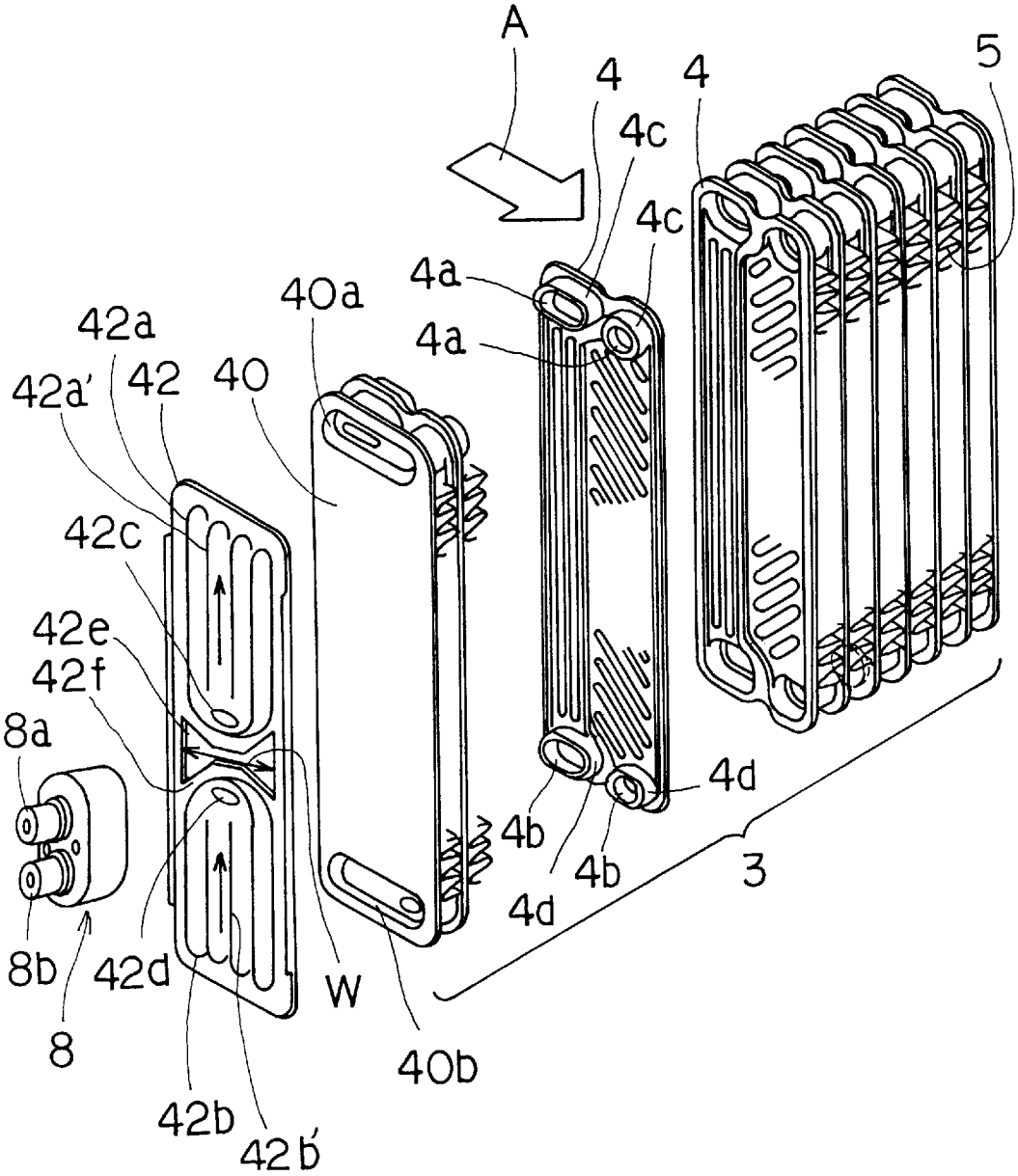
FIG. 1 is an exploded perspective view showing an evaporator in an embodiment of the present invention.
Figure 2:
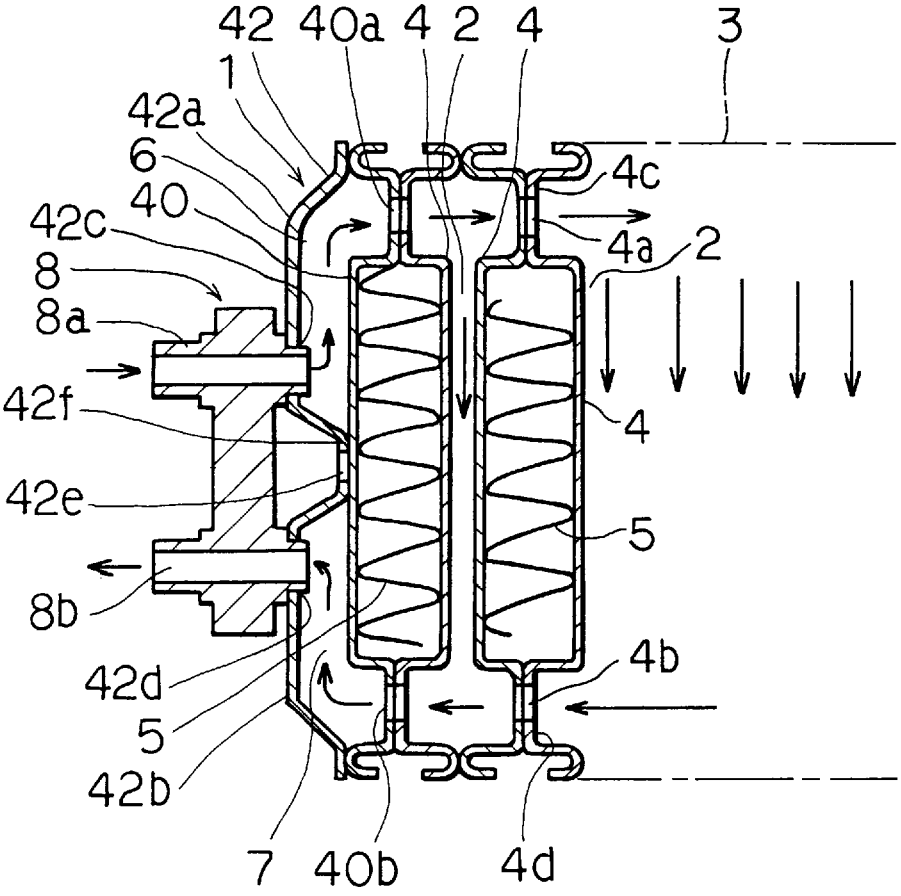
FIG. 2 is a cross-sectional view showing a main portion of the evaporator in the embodiment.

As shown in FIG. 2, the evaporator 1 has a heat exchanging portion 3 including a plurality of refrigerant passages (fluid passages) 2, which are in parallel with each other, for heat exchanging between the refrigerant flowing in the refrigerant passages 2 and air (outside fluid). In FIG. 1, an arrow A indicates a flowing direction of the air.

The heat exchanging portion 3 is formed by a laminated structure of thin metal plates 4, which may be basically a known structure. The laminated structure will be briefly described. In the heat exchanging portion 3, each thin metal plate 4 is specifically composed of a core member made of aluminum (A3000 series) and clad members claded on both surfaces of the core member by cladding brazing material (A4000 series), and is formed in a predetermined shape. Each thickness of the thin metal plates 4 is approximately 0.6 mm. A plurality of pairs of the thin metal plates 4 forming one of the refrigerant passages 2 are laminated and integrally brazed, so that the refrigerant passages 2 are formed in parallel.

Further, tank portions 4*c* and 4*d* having communication holes 4*a* and 4*b* for communicating the plurality of the refrigerant passages 2 at both ends (upper and lower ends in FIG. 2) respectively are formed on both end portions of the thin metal plate 4. The tank portions 4*c* and 4*d* are formed at a cylindrical protruding portion which protrudes outwardly in a laminating direction of the thin metal plate with respect to the fluid passages 2. That is, each refrigerant passage 2 communicates with adjacent refrigerant passage 2 through the communication holes 4*a* and 4*b* at both end portions of the thin metal plate 4.

Corrugated fins 5 are respectively disposed between the pair of the adjacent fluid passages 2 to increase a heat transmitting area toward the air. The corrugated fins 5 are made of aluminum bare material such as A3003 without being claded with brazing material.

A joining metal plate 40 disposed at one end portion of the laminated metal plates 4, an end plate 42 joined to the joining metal plates 40, and another end plate 43 disposed at the other end of the laminated metal plates 4 (see FIG. 3) are made of the same materials as those of the thin metal plates 4. Each of these plates. 40, 42 and 43 has a thickness being thicker than that of the thin metal plates 4 to secure a mechanical strength. In this embodiment, the thickness of the joining metal plate 40 and the end plates 42 and 43 is approximately 1 mm.

The joining metal plate 40 has a refrigerant inlet hole 40*a* and a refrigerant outlet hole 40*b* at both ends thereof. The refrigerant inlet hole 40*a* communicates with the tank portions 4*c*, and the refrigerant outlet hole 40*b* communicates with the tank portions 4*d*.

Figure 3:
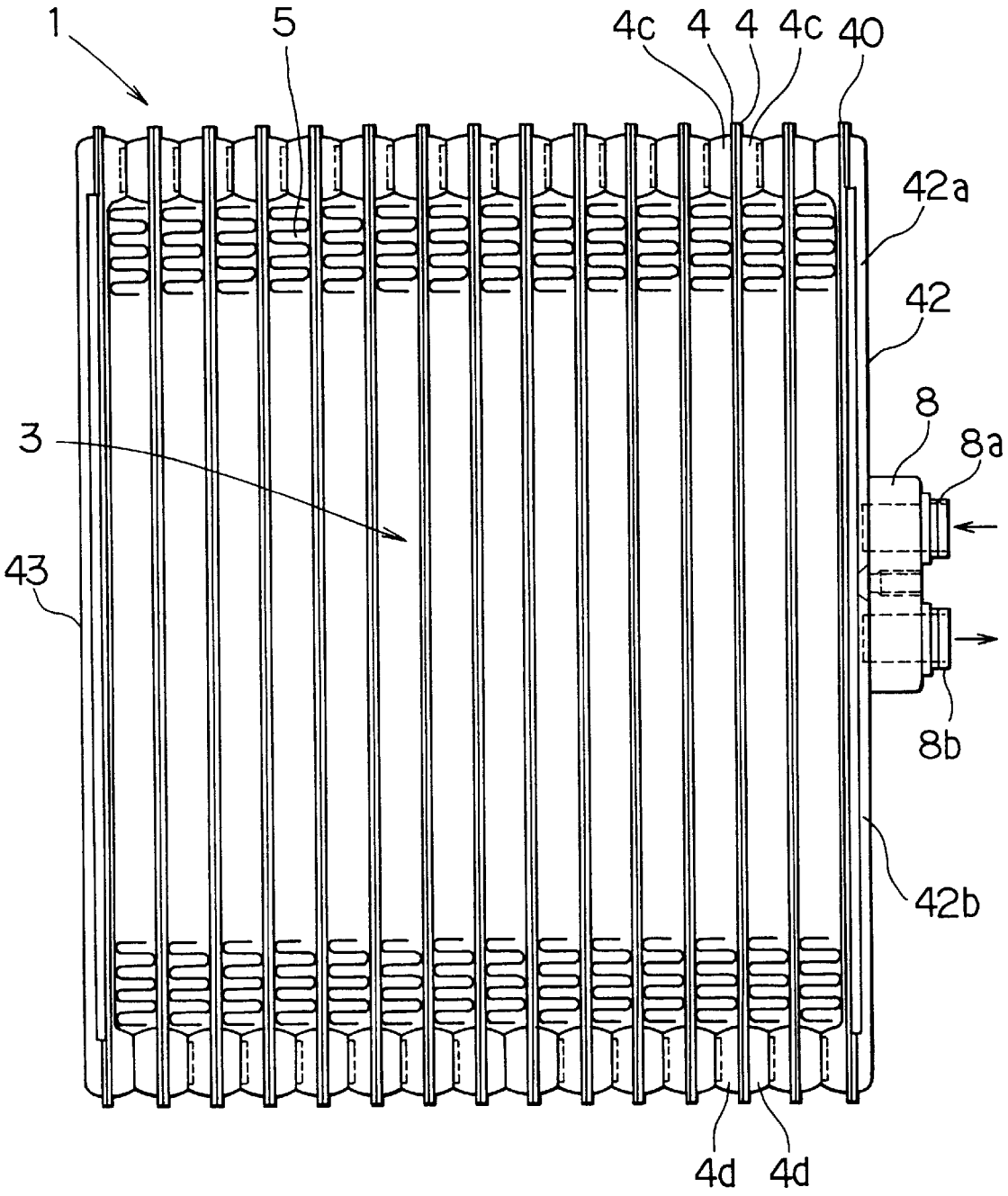
FIG. 3 is a plane view showing the evaporator in the embodiment.

As shown in FIG. 3, the end plate 43 is disposed at the outer-most side in the heat exchanging portion 3 to protect one of the corrugated fins 5 as well as reinforce the end of the heat exchanging portion 3.

On the other hand, as shown in FIG. 2, the end plate 42 connected to the joining metal plate 40 has two protrusions 42*a* and 42*b* protruding toward an opposite side of the joining metal plates 40 in the metal plate laminating direction. Spaces formed between the protrusions 42*a* and 42*b* and the joining metal plate 40 function as a refrigerant inlet passage 6 and a refrigerant outlet passage 7. The refrigerant inlet passage 6 communicates with the refrigerant passages 2 through the refrigerant inlet hole 40*a* and the tank portions 4*c*, and the refrigerant outlet passage 7 communicates with the refrigerant passages 2 through the refrigerant outlet hole 40*b* and the tank portions 4*d*.

As shown in FIG. 1, concave and convex shaped ribs 42*a*' and 42*b*' are integrally formed on the protrusions 42*a* and 42*b* respectively, for reinforcing the end plate 42. The ribs 42*a*' and 42*b*' are formed in parallel with a flowing direction of the refrigerant, so that the resistance of the refrigerant flowing in the refrigerant inlet and outlet passages 6 and 7 is lowered.

Further, the protrusions 42*a* and 42*b* have through holes 42*c* and 42*d* passing therethrough, and a connection pipe joint 8 for connecting with the outside refrigerant circuit is connected to through holes 42*c* and 42*b*. The pipe joint 8 is made of aluminum bare material of A6000 series.

The pipe joint 8 is integrally formed with a refrigerant inlet pipe 8*a* and a refrigerant outlet pipe 8*b*, which are fitted into the through holes 42*c* and 42*d* of the end plate 42 and brazed therewith. The refrigerant inlet pipe 8*a* fitted into the through hole 42*c* communicates with an outlet pipe of the expansion valve (not shown), and the refrigerant outlet pipe 8*b* fitted to the through hole 42*d* communicates with a compressor suction pipe for sucking the gaseous refrigerant evaporated in the evaporator toward a compressor (not shown).

The end plate 42 further has a joining portion 42*f* to be connected to the joining metal plate 40 between the protrusions 42*a* and 42*b*. Furthermore, another through hole 42*e* (see FIGS. 1 and 2) is formed on the end plate 42 at the center of the joining portion 42*f* to detect an internal leakage of the refrigerant (described later) and has nothing to do with the refrigerant passage of the evaporator 1. To detect the internal leakage, a width W of the through hole 42*e* is set to be equal to a width of the protrusions 42*a* and 42*b* or more, as shown in FIG. 1.

A shape of the through hole 42*e* is set so that the joining portion 42*f* surrounding the through hole 42*e* has generally a predetermined width at an entire circumference thereof.

That is, to secure the joining strength (brazing strength) between the joining portion 42*f* of the end plate 42 and the joining metal plate 40, the width of the joining portion 42*f* should be 1–2 mm. To satisfy the width dimension of the joining portion 42*f*, in this embodiment, the shape of the through hole 42*e* is selected in a shape where tops of two triangles are connected to each other as shown in FIG. 1.

Next, a method for manufacturing the evaporator 1 will be described.

After laminated and assembled temporarily as shown in FIG. 3, the evaporator 1 is carried into a brazing furnace while the temporarily assembled state is kept with adequate fixtures. Then, the temporarily assembled evaporator 1 is heated to a melting point of the brazing material which are claded with the aluminum, and each joining portion is integrally brazed.

Next, a leakage inspection is performed on the evaporator 1. In the leakage inspection, one of the refrigerant inlet pipe 8*a* and refrigerant outlet pipe 8*b*, which is an opening portion communicating with outside, is closed by an adequate plug, and the other of those is opened. For example, the refrigerant inlet pipe 8*a* is closed and the refrigerant outlet pipe 8*b* is opened.

In this state, the evaporator 1 is carried to an airtightly closed chamber and the refrigerant outlet pipe 8*b* is connected with an apparatus for supplying a leakage detecting fluid (for example, helium gas). The leakage detecting fluid is pressurized to a predetermined pressure and supplied into the evaporator 1 through the refrigerant outlet pipe 8*b*. Since the refrigerant inlet pipe 8*a* is closed, in the case that there are some defective brazed portions in the evaporator 1, the leakage detecting fluid leaks from the defective brazed portions into the airtightly closed chamber, whereby the internal leakages are detected.

Especially, in the case that the joining portion 42*f* has some defective brazed portions between the protrusions 42*a* and 42*b* of the end plate 42, the leakage detecting fluid always leaks to outside from the through hole 42*e* through the defective brazed portions, because the through hole 42*e* is positioned at the center of the joining portion 42*f* and has the width being equal to the width of the protrusions 42*a* and 42*b* or more. As a result, in the evaporator 1, the internal leakages of the leakage detecting fluid can be detected securely.

Figure 4:
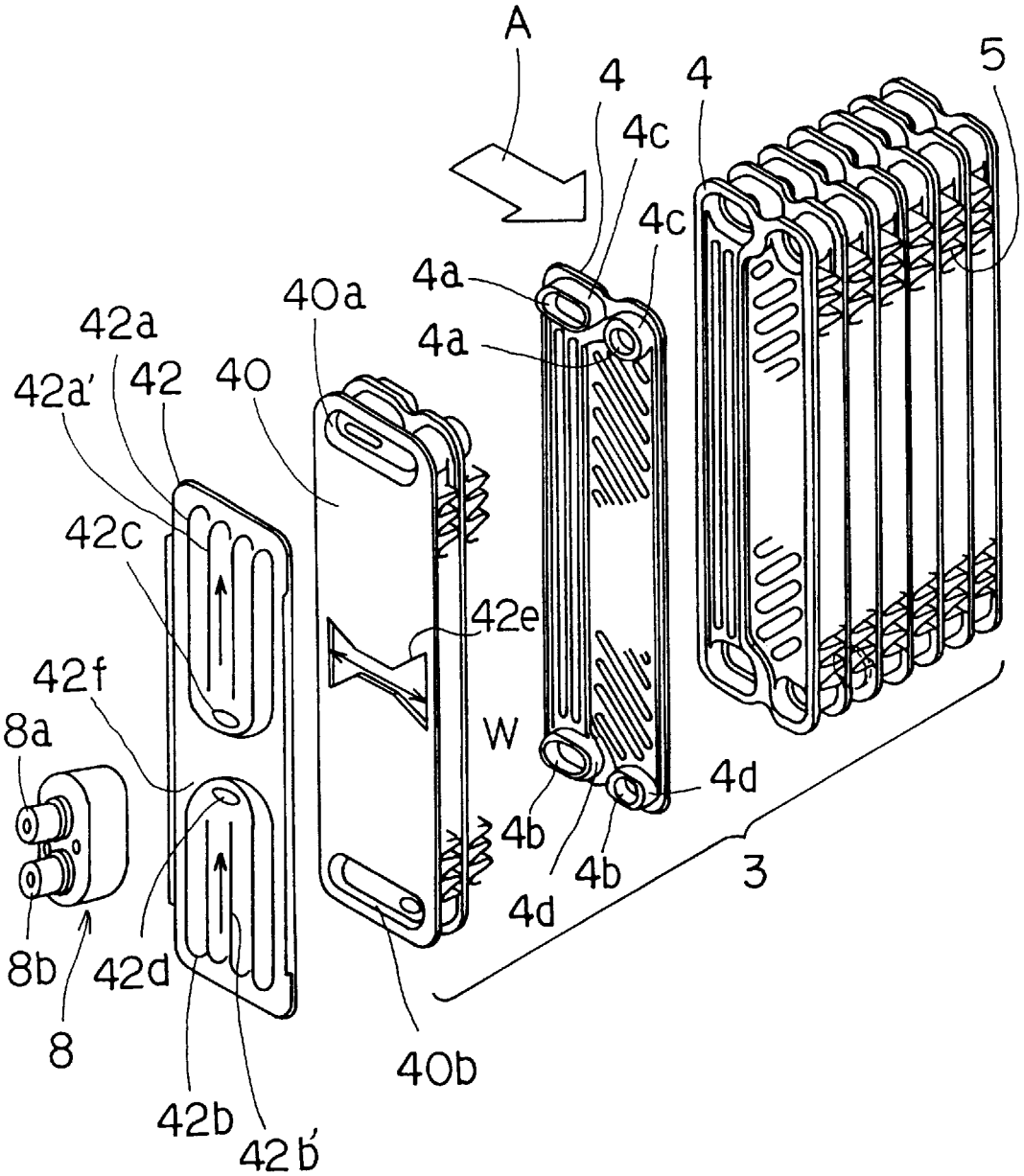
FIG. 4 is an exploded perspective view showing an evaporator in a modification of the present invention.

Although, in this embodiment, the through hole 42*e* is formed on the end plate 42, as shown in FIG. 4, it may be formed on the joining metal plate 40 so as to be positioned at the center of the joining portion 42*f* when the end plate 42 and the thin metal plate 40 are joined.

Figure 5:
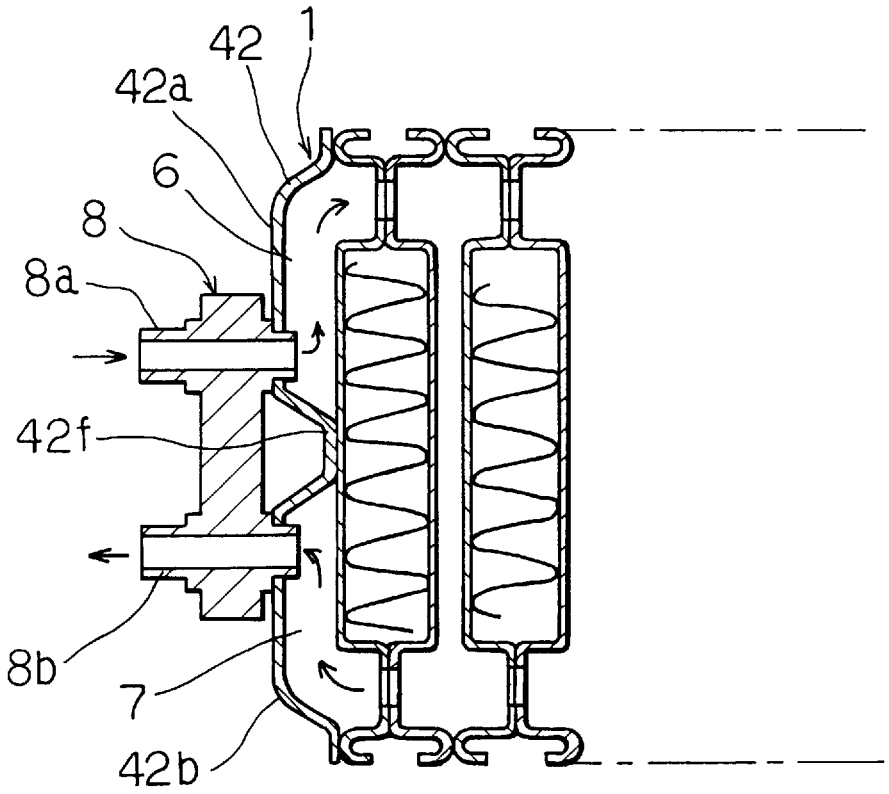
FIG. 5 is a cross-sectional view showing an evaporator as a comparative example.

To compare with this embodiment, a comparative example shown in FIG. 5 has been manufactured and examined by inventors. The comparative example does not have the through hole 42*e* on the end plate 42, also on the joining metal plate 40. The other features of the comparative example are the same as those in the embodiment. In this comparative example, even if the joining portion 42*f* has defective brazed portion, the fluid passes through the defective brazed portion between the refrigerant inlet passage 6 and the refrigerant outlet passage 7, and does not leak to the outside. As a result, any internal leakages can not be detected by the above mentioned leakage inspection.

In this embodiment, the internal leakages can be detected securely by means of the through hole 42*e*, the defective product having an internal leakage can be prevented from being produced.

The present invention is not limited to the refrigerant evaporator and can be adopted to various types of heat exchangers.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A laminated type heat exchanger comprising:

a heat exchanging portion formed by laminating a plurality of thin metal plates in which a longitudinal fluid passage having an inlet portion and an outlet portion is formed for heat exchanging between an inside fluid flowing inside said fluid passage and an outside fluid flowing outside said fluid passage, said thin metal plates including a side plate disposed on an end portion of said heat exchanging portion in a laminated direction thereof; and an end plate having two protrusions and a joining portion between said two protrusions, said end plate being joined to said side plate at said joining portion thereof in said laminated direction of said thin metal plates, said two protrusions facing each other via said joining portion and communicating respectively with said inlet portion and said outlet portion;

wherein at least one of said joining portion and said side plate includes a hole extending between said two protrusions, said hole extending transverse to said longitudinal fluid passage, said hole communicating with an environment outside of the laminated type heat exchanger.

2. A laminated type heat exchanger according to claim 1, wherein said one of said joining portion and said side plate includes a contacting portion formed around an entire outer circumference of said hole with a uniform width for contacting with the other one of said joining portion and said side plate.

3. A laminated type heat exchanger according to claim 2, wherein said uniform width is in a range of 1–2 mm.

4. A laminated type heat exchanger according to claim 1, further comprising:

a joint member connected to said end plate, said joint member having an inlet pipe communicating with said inlet portion through one of said two protrusions and an outlet pipe communicating with said outlet portion through the other of said two protrusions.

5. A laminated type heat exchanger according to claim 4, wherein said joint member is disposed between said two protrusions.

6. A laminated type heat exchanger according to claim 1, wherein said inside fluid is a refrigerant in a refrigerating cycle, and said refrigerant is evaporated by heat exchanging with said outside fluid.

7. A laminated type heat exchanger according to claim 1, wherein, each of said thin metal plates includes an inlet hole at one end portion thereof and an outlet hole at the other end portion, and said thin metal plates are laminated such that a plurality of said inlet holes communicate with each other and a plurality of said outlet holes communicate with each other to form said fluid passage.

8. A laminated type heat exchanger according to claim 1, wherein, a plurality of inside fluid passages for forming a part of said fluid passage are formed between a first pair of adjacent thin metal plates.

9. A laminated type heat exchanger according to claim 8, further comprising:

a corrugated fin disposed between a second pair of adjacent thin metal plates.

10. A laminated type heat exchanger according to claim 1, wherein said hole is formed in a shape in which tops of two triangles are connected to each other.

11. A laminated type heat exchanger according to claim 1 wherein:

said end plate has a generally rectangular shape: and said two protrusions are provided on both sides in a longitudinal direction of said end plate with said joining portion interposed therebetween.

12. A laminated type heat exchanger comprising:

a heat exchanging portion formed by laminating a plurality of thin metal plates in which a fluid passage having an inlet portion and an outlet portion is formed, for heat exchanging between an inside fluid flowing inside said fluid passage and an outlet fluid flowing outside said fluid passage; and an end plate laminated at an end portion of said heat exchanging portion in a laminated direction of said thin metal plates, said end plate generally having a rectangular shape and having two protrusions provided on both sides in a longitudinal direction of said end plate and a joining portion between said two protrusions to be integrally joined to a side surface of said heat exchanging portion, said two protrusions separated from each other via said joining portion and communicating respectively with said inlet portion and said outlet portion, said protrusions extending towards each other from opposed ends of said end plate;

wherein at least one of said joining portion and a thin metal plate forming said side surface to which said joining portion is joined includes a hole communicating with an environment outside of the laminated type heat exchanger.

13. A laminated type heat exchanger according to claim 12, wherein a width of said hole perpendicular to said longitudinal direction of said end plate is equal to or larger than a width of each of said two protrusions perpendicular to said longitudinal direction of said end plate.

14. A laminated type heat exchanger according to claim 12, wherein said hole extends at least at a position where said two protrusions face each other.

15. A laminated type heat exchanger comprising:

a heat exchanging portion including a plurality of laminated thin metal plates in which a longitudinal fluid passage having an inlet portion and an outlet portion is formed for heat exchanging between an inside fluid flowing inside said fluid passage and an outside fluid flowing outside said fluid passage, said thin metal plates including a side plate disposed on an end portion of said heat exchanging portion in a laminated direction thereof; and an end plate having two protrusions and a joining portion between said two protrusions, said end plate joined to said side plate at said joining portion thereof in said laminated direction of said thin metal plates, said two protrusions facing each other via said joining portion to be separated from each other and communicating respectively with said inlet portion and said outlet portion;

wherein one of said end plate and said side plate has a hole between said two protrusions, said hole communicating with an environment outside of said laminated type heat exchanger for conducting said inside fluid leaked from at least one of said two protrusions through said joining portion to said environment outside of said laminated type heat exchanger, said hole extending transverse to said longitudinal fluid passage.

16. A laminated type heat exchanger according to claim 15, wherein the hole of said one of said end plate and said side plate is provided at least at a position where said two protrusions face each other.

17. A laminated type heat exchanger according to claim 15 wherein:

said end plate has a substantially rectangular shape; and said two protrusions are respectively provided on both sides in a longitudinal direction of said end plate with a width perpendicular to said longitudinal direction.

18. A laminated type heat exchanger according to claim 17, wherein a width of said hole of one of said end plate and said side plate is equal to or larger than said width of said two protrusions.

* * * * *